United States Patent [19]

Hori

[11] Patent Number: 4,810,115

[45] Date of Patent: Mar. 7, 1989

[54] CHARACTER SELECTING MECHANISM

[75] Inventor: Fumihisa Hori, Takizawa, Japan

[73] Assignee: Alps Electric Co., Ltd., Japan

[21] Appl. No.: 89,728

[22] Filed: Aug. 26, 1987

[30] Foreign Application Priority Data

Oct. 3, 1986 [JP] Japan ..... 61-152357[U]

[51] Int. Cl.[4] ..... B41J 7/76

[52] U.S. Cl. ..... 400/163.1; 335/265; 101/93.22; 192/84 AA; 400/155

[58] Field of Search ..... 335/265; 192/84 AA, 192/84 C; 400/163.3, 163.1, 185, 155, 151.1; 101/93.21, 93.23, 93.28

[56] References Cited

U.S. PATENT DOCUMENTS

| | | | |
|---|---|---|---|
| 2,224,254 | 12/1940 | Cotal | 192/84 AA |
| 2,510,880 | 6/1950 | Fredrikson | 192/84 AA |
| 2,888,532 | 5/1959 | Braumann | 335/265 |
| 2,946,875 | 7/1960 | Waldhaner, Jr. | 335/265 |
| 3,204,057 | 8/1965 | Magida | 335/265 |
| 4,706,562 | 11/1987 | Hori | 101/93.22 |

FOREIGN PATENT DOCUMENTS

| | | | |
|---|---|---|---|
| 163879 | 7/1986 | Japan | 400/163.3 |
| 2095181 | 9/1982 | United Kingdom | 101/93.22 |

*Primary Examiner*—William Pieprz

*Attorney, Agent, or Firm*—Guy W. Shoup; Paul J. Winters; Brian D. Ogonowsky

[57] ABSTRACT

A character selecting mechanism for a printer having a plurality of type wheel units arranged axially on a shaft. The character selecting mechanism comprises a plurality of electromagnetic clutches each having a solenoid, a sleeve rotatably received in the center hole of the solenoid and rotated continuously during a printing cycle, and a pair of selector plates resiliently pressed against the opposite end surfaces of the sleeve, respectively, so as to be attracted to the sleeve and to be turned by the sleeve when the solenoid is energized, having tongues facing opposite to each other to form part of a magnetic path for the magnetic lines of force of the solenoid with a small gap therebetween and in contact with each other through a small contact area. Each electromagnetic clutch controls a pair of type wheel units to stop the respective type wheels of the pair of type wheel units individually to position the selected characters of the type wheels at the printing position. Small projections are formed either in one of the opposite surfaces of the tongues or in both the opposite surfaces of the tongues so that the tongues are in contact with each other through a small contact area so that the selector plates are able to be turned individually.

3 Claims, 7 Drawing Sheets

CHARACTER SELECTING MECHANISM

BACKGROUND OF THE INVENTION

1. Field of the Invention

The present invention relates to a character selecting mechanism for a printer, for selectively positioning characters of type wheels on the basis of print command, and is an improvement of a character selecting mechanism having a plurality of electromagnetic clutches each for properly controlling two type wheels, proposed previously by the same applicant.

2. Description of the Prior Art

The conventional printer provided with a character selecting mechanism and a plurality of axially juxtaposed type wheels each having the types of letters, numerals and symbols (hereinafter referred to as "characters"), and rotatably supported on a shaft positions the characters selectively for printing operation by means of selector fingers. The conventional character selecting mechanism has a plurality of electromagnetic means each associated with a single type wheel. The electromagnetic means is actuated selectively to make the selector finger engage a recess on the type wheel so that a selected character is stopped at the printing position.

Since the conventional character selecting mechanism comprises a plurality of electromagnetic means each associated with a single type wheel, the character selecting mechanism is complex in construction, has many parts and consumes much electric power for operation.

SUMMARY OF THE INVENTION

A principal object of the present invention is to provide a character selecting mechanism having electromagnetic clutches each for individually driving two selector plates, suitable for operation in combination with comparatively low-speed printers, comprising less parts, simple in construction, easy to be assembled, and possible to be manufactured at a low cost.

To achieve the object of the invention, the present invention provides a character selecting mechanism comprising: a plurality of electromagnetic clutches each having a solenoid, a sleeve rotatably received in the center hole of the solenoid and rotated continuously during a printing cycle, and a pair of selector plates resiliently pressed against the opposite end surfaces of the sleeve, respectively, so as to be attracted to the sleeve and to be turned by the sleeve when the solenoid is energized, having tongues facing opposite to each other to form part of a magnetic path for the magnetic lines of force of the solenoid with a small gap therebetween and in contact with each other through a small contact area.

According to the present invention, the pair of selector plates each having a selector finger are driven individually by a single electromagnetic clutch. A closed magnetic field of the electromagnet of the electromagnetic clutch is formed simply by placing tongues formed in the selector plates, respectively, in direct contact with each other. Since the selector plates are placed with the tongues thereof disposed close to each other and with small projections formed in the tongues in direct contact with each other, the contact area is small and hence the selector plates can be individually driven relative to each other.

Accordingly, the character selecting mechanism is suitable for use in combination with a comparatively low-speed printer, requires a comparatively small number of parts, easy to be assembled, and possible to be manufactured at a low cost.

BRIEF DESCRIPTION OF THE DRAWINGS

The above and other objects, features and advantages of the present invention will become more apparent from the following description taken in conjunction with the accompanying drawings, in which.

DESCRIPTION OF THE PREFERRED EMBODIMENT

Figure 1:
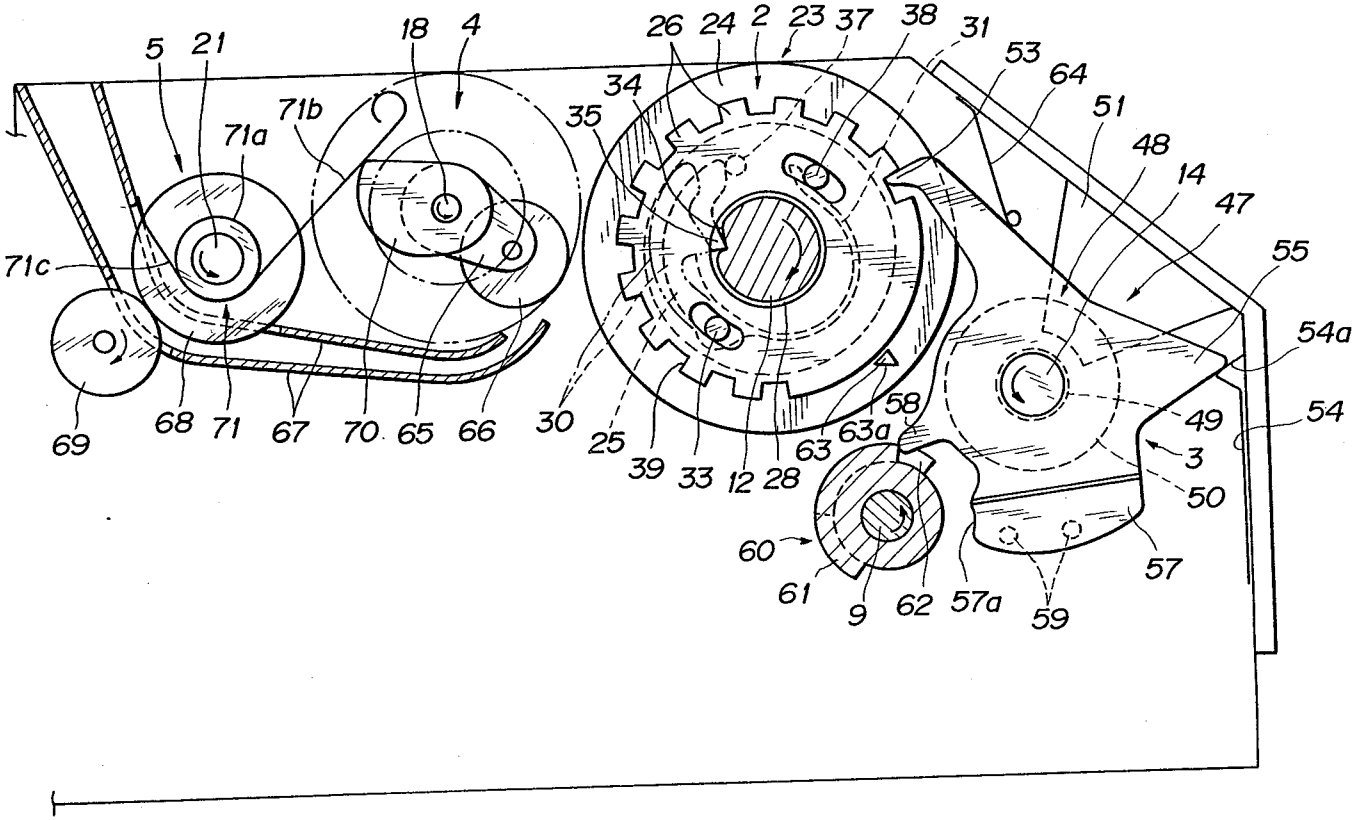
FIG. 1 is a fragmentary sectional side elevation of a printer incorporating a character selecting mechanism, in a preferred embodiment, according to the present invention.
Figure 2:
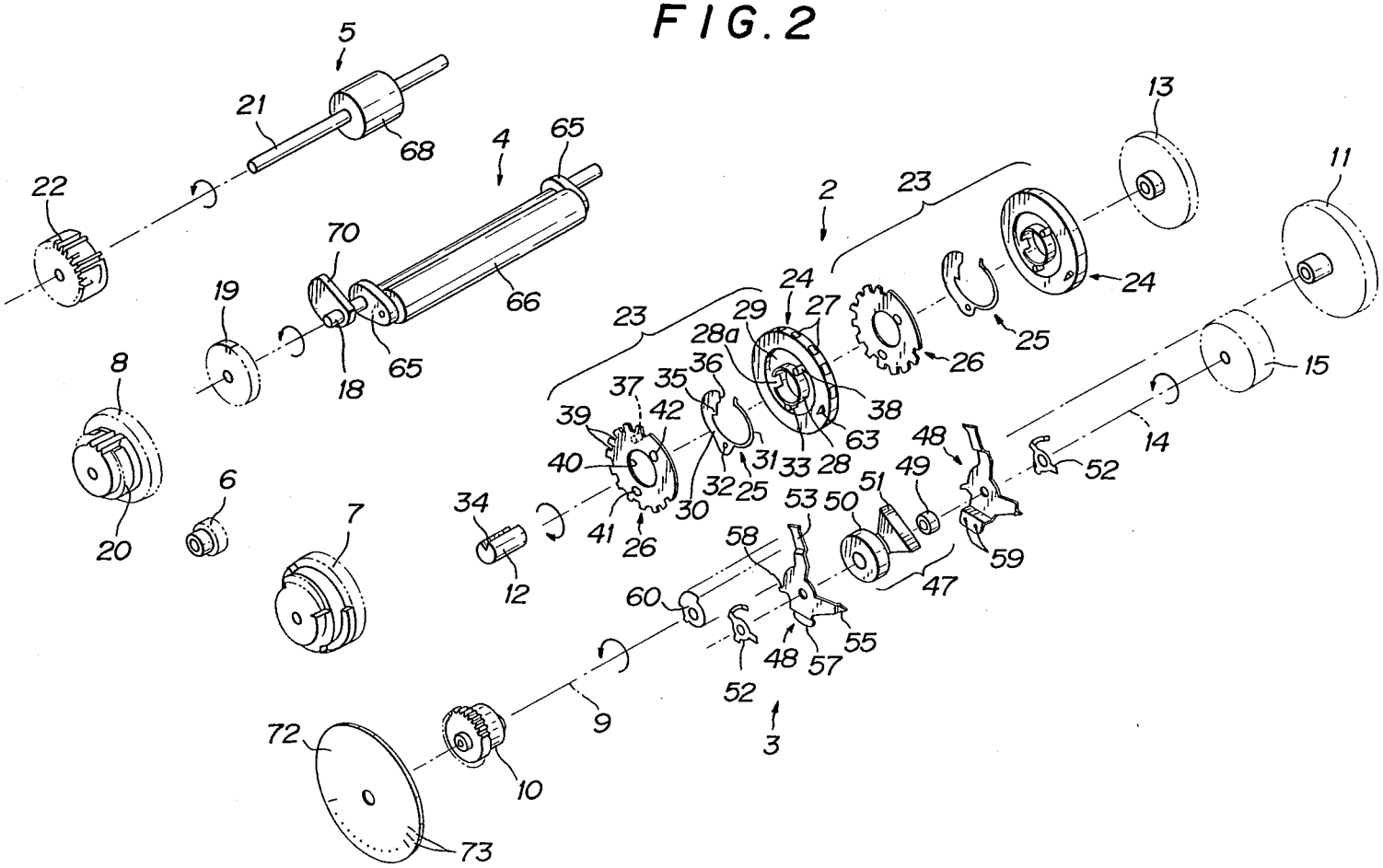
FIG. 2 is an exploded perspective view of the essential portion of the printer of FIG. 1.

Referring to FIGS. 1 and 2, shown therein is a printer incorporating a character selecting mechanism, in a preferred embodiment, according to the present invention. The printer repeats a printing cycle for printing operation. The printing cycle is started when a print start signal is given to the printer. The printing cycle includes a phase where all the components are positioned at initial positions, respectively, a phase in which a character to be printed is selected, a phase in which the character is printed on a recording sheet, and a phase in which the recording sheet is fed and the components are returned to the initial positions simultaneously. The printing cycle is terminated when a print end signal is given to the printer. The printer comprises a type wheel mechanism 2, a character selecting mechanism 3, a printing mechanism 4, and a sheet feed mechanism 5. These mechanisms 2, 3, 4 and 5 are housed in a case 1.

A power transmission system for rotatively driving the type wheel mechanism 2, the character selecting mechanism 3, the printing mechanism 4 and the sheet feed mechanism 5 will be described hereinafter with reference to FIG. 2, in which designations right and left correspond to right-hand and left-hand, respectively, in the drawing. A driving gear 6 is driven by a driving motor, not shown, for continuous rotation. Two idle gears 7 and 8 are in mesh with the driving gear 6. The idle gear 7 is in mesh with a sensor gear 10 secured to the left end of a cam shaft 9. A transmission gear 11 is secured to the right end of the cam shaft 9. A transmission gear 13 secured to the right end of a first shaft 12 is in mesh with the transmission gear 11. A transmission gear 15 secured to the right end of a second shaft 14 is in mesh with the transmission gear 13. The other idle gear 8 is in mesh with a transmission gear 19 secured to the left end of a third shaft 18. A partial gear 20 is combined coaxially and fixedly with the idle gear 8. The partial gear 20 is in mesh with a transmission gear 22 secured to the left end of a fourth shaft 21. The shafts 9, 12, 14, 18 and 21 rotate in directions indicated by arrows, respectively. During the printing cycle, the cam shaft 9 rotates for one turn, the first shaft 12 rotates for two turns, the second shaft 14 rotates continuously while the first shaft 12 is rotating, the third shaft rotates for one turn, and the fourth shaft 21 turns only for feeding the recording sheet.

The type wheel mechanism 2, the character selecting mechanism 3, the printing mechanism 4 and the sheet feed mechanism 5 will be described hereinafter in that order.

Figure 3:
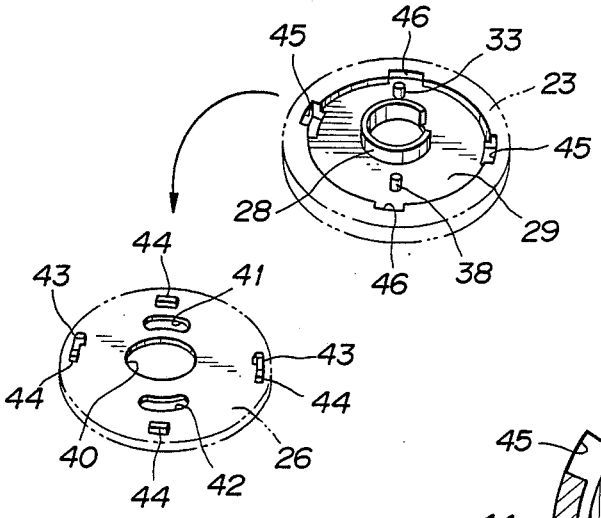
FIG. 3 is an exploded perspective view showing the combination of a type wheel and an selector ratchet.
Figure 4:
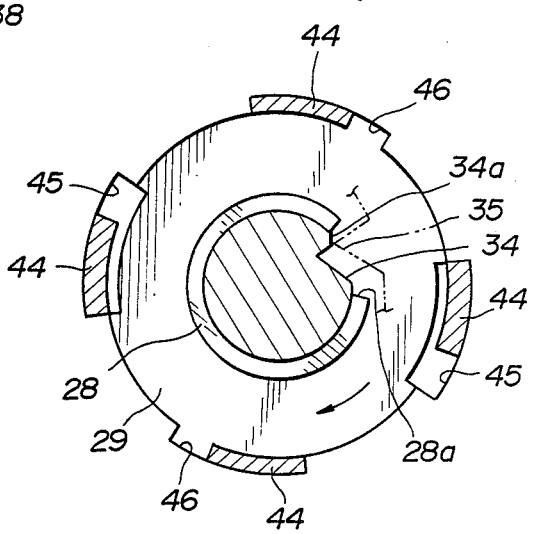
FIG. 4 is a sectional view of assistance in explaining the relative disposition of the type wheel and the selector ratchet when the type wheel is stopped.
Figure 5:
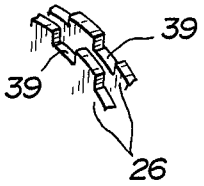
FIG. 5 is a fragmentary perspective view showing the relative position of the respective notches between the adjacent teeth of the selector ratchets of a pair of type wheel units in the initial position.
Figure 6:
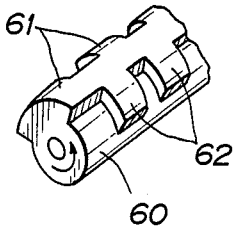
FIG. 6 is a fragmentary perspective view of a cam.
Figure 7A:
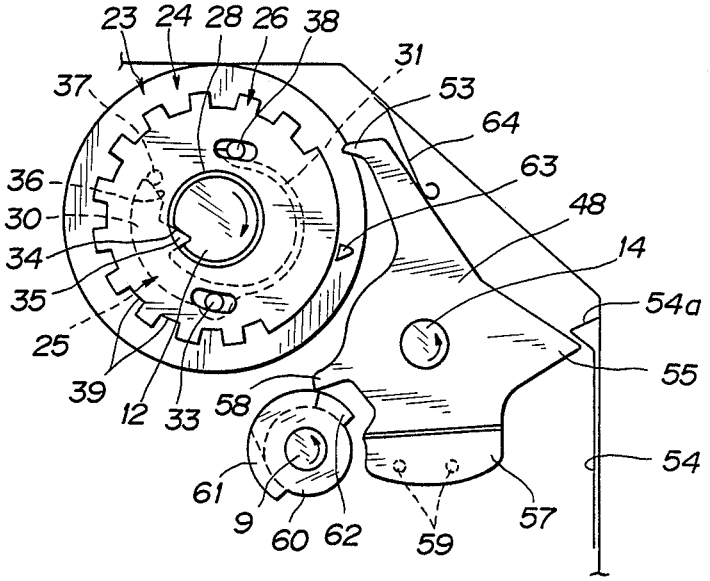
FIGS. 7(*a*) to 7(*h*) are side elevations of assistance in explaining the manner of operation of the type wheel mechanism and the character selecting mechanism, showing various positions of the type wheel mechanism and the character selecting mechanism during different phases of the cycle of operation.
Figure 7B:
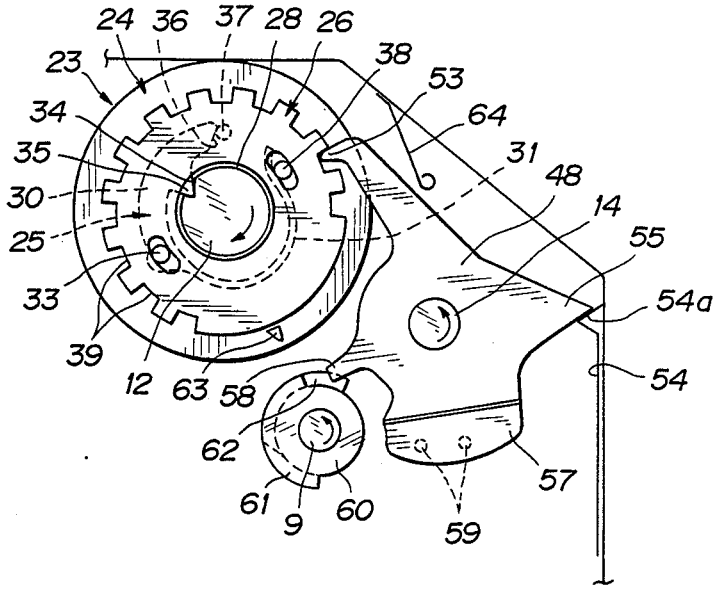
Figure 7C:
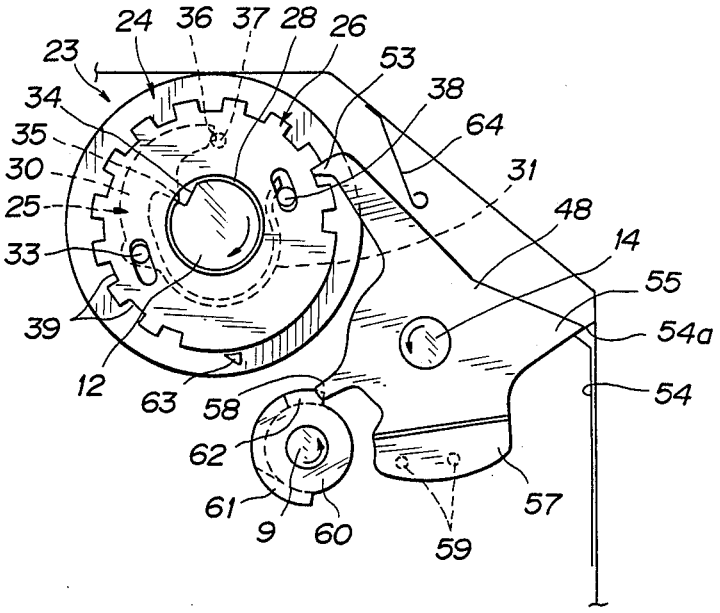
Figure 7D:
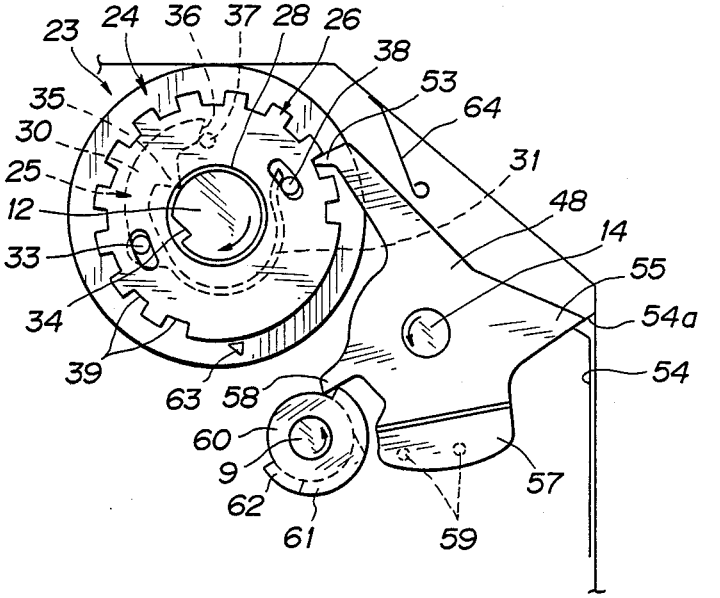
Figure 7E:
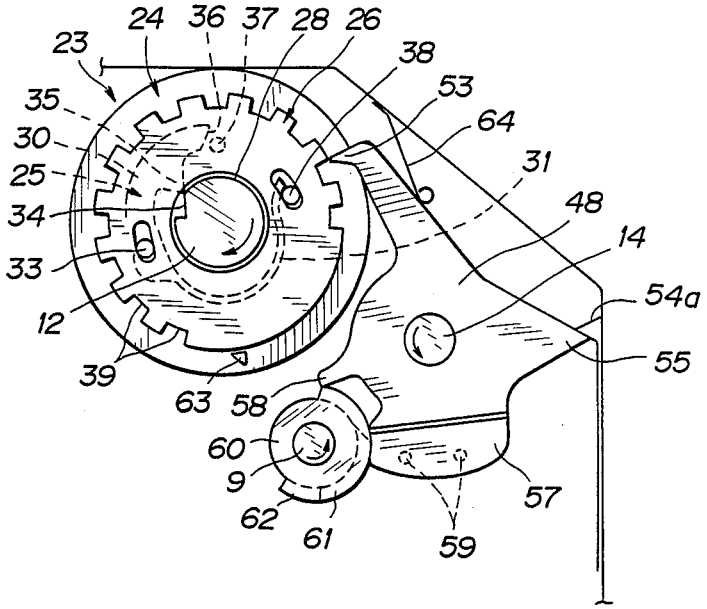
Figure 7F:
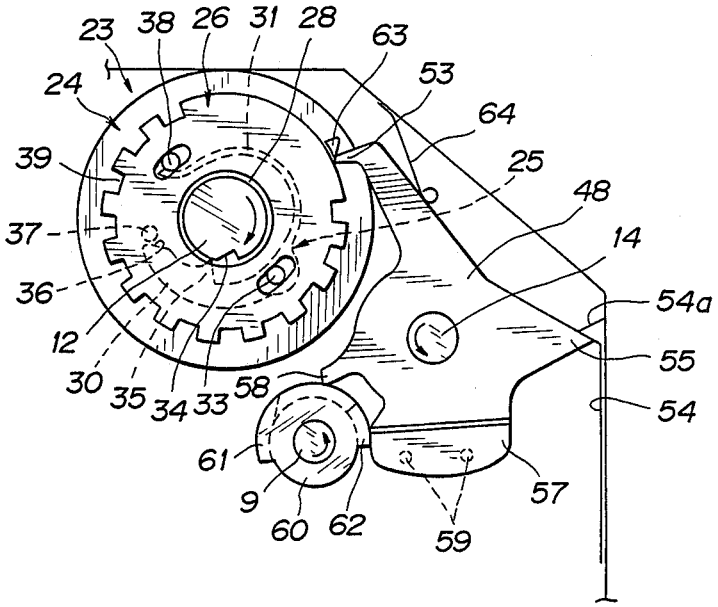
Figure 7G:
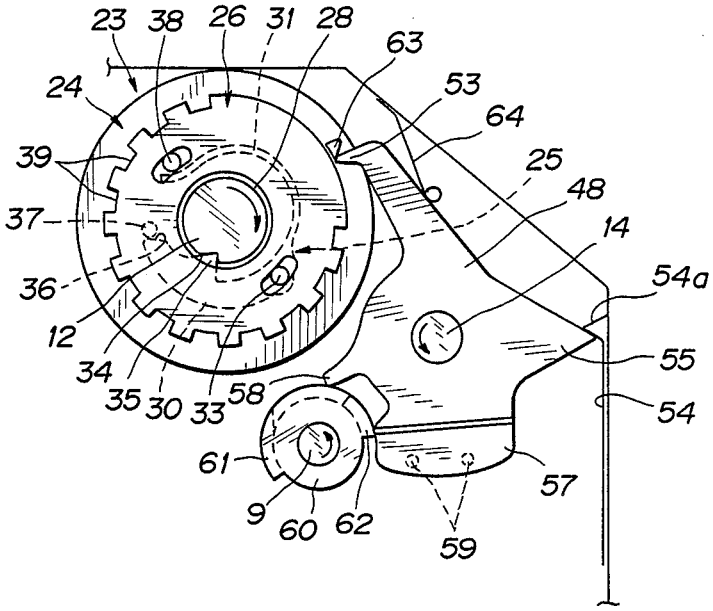
Figure 7H:
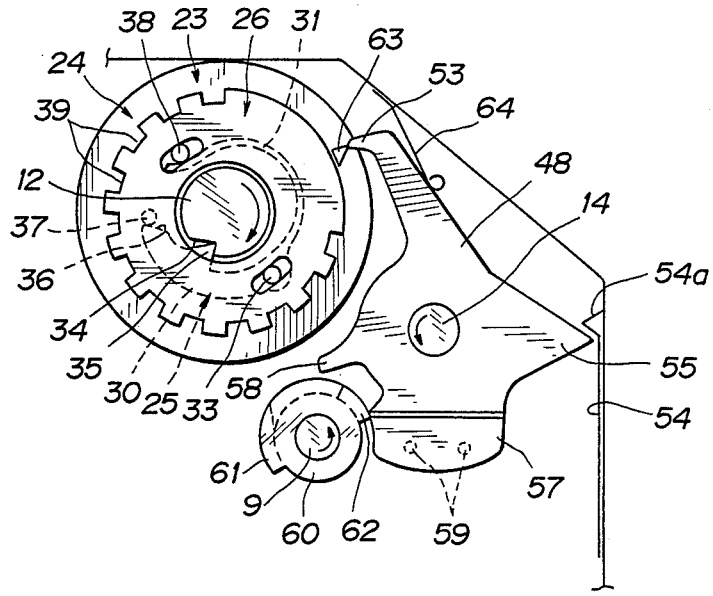

The type wheel mechanism comprises a plurality of type wheel units 23, for example, eighteen type wheel units 23 for printing a row of eighteen characters including letters, numerals and symbols. The type wheel units 23 are mounted on the first shaft 12 in a parallel arrangement along the axis of the first shaft 12. In FIG. 1, two adjacent type wheel units 23 are illustrated. The respective type wheels 24 of these two type wheel units 23 are controlled for character selection by one of the electromagnetic clutches 47 of the character selecting mechanism 3. Each type wheel unit 23 comprises a type wheel 24, a clutch plate 25 and a selector ratchet 26. The type wheel 24 is formed substantially in the form of a disk and is provided with twelve types 27 on the circumference thereof and with a boss 28 in the central portion thereof. The type wheel 24 is mounted rotatably on the first shaft 12. The clutch plate 25 interlocks the type wheel 24 with or disengages same from the first shaft so that the type wheel 24 rotates together with the first shaft 12 or the type wheel 24 is able to rotate relative to the first shaft 12. The clutch plate 25 is fitted in an annular recess formed in the side surface of the type wheel 24 around the boss 28. As illustrated in FIG. 2, the clutch plate 25 is a partly broken, thin annular plate having a rigid portion 30, a flexible portion 31 and a small hole 32 formed at the junction of the rigid portion 30 and the flexible portion 31. When fitted in the annular recess 29, the clutch plate 25 receives a pin 33 projecting from the bottom surface of the annular recess 29 through the small hole 32 and is swingable on the pin 33. A projection 35 projects from the inner circumference of the rigid portion 30 of the clutch plate 25 through a cut **28*a* formed in the boss 28 so as to engage with a substantially V-shaped axial groove 34 or disengage from same. The free end of the rigid portion 30 of the clutch plate 25 is cut obliquely to form a nose 36. A pin 37 projecting from the side of the selector ratchet 26 facing the type wheel 24 engages the nose 36 to disengage the projection 35 from the groove 34. The free end of the flexible portion 31 of the clutch plate 25 is engaged with a pin 38 projecting from the bottom surface of the annular recess 29 of the type wheel 24, so that the rigid portion 30 is urged resiliently in a direction to bring the projection 35 into engagement with the groove 34. The selector ratchet 26 is formed in the form of a thin disk and is provided in the circumference thereof with notches 39 corresponding to the types 27 of the type wheel 24, respectively. When the type wheel 24, the clutch plate 25 and the selector ratchet 26 are combined, the clutch plate 25 is placed between the type wheel 24 and the selector ratchet 26, the boss 28 of the type wheel 24 is received rotatably in the central hole 40 of the selector ratchet 26, the pins 33 and 38 of the type wheel 24 are received in slots 41 and 42 of a circular arc, respectively, and two hooks 43 projecting from two protrusions 44 among four protrusions 44 formed on the side surface of the selector ratchet 26 are received in two openings 45 formed in the annular recess 29 of the type wheel 24, respectively (FIGS. 3 and 4). The other two protrusions 44 of the selector ratchet 26 are received loosely in two recesses 46 of the type wheel 24, respectively. The four protrusions 44, the two openings 45 and the two recesses 46 constitute a stopping mechanism for stopping the type wheel 24 at a fixed position by the selector ratchet 26. As illustrated in FIG. 5, the respective phases of the respective selector ratchets 26 of the two adjacent type wheel units 23 (FIG. 1) are shifted by half a pitch of the teeth relative to each other when the type wheel units 23 are in the initial position in order to selectively stop the respective type wheels of the two type wheel units 23 at appropriate positions by means of selector plates 48 which are driven individually by an electromagnetic clutch 47 of the character selecting mechanism 3**.

The character selecting mechanism 3 stops the type wheel unit 23 which normally is rotating together with the first shaft 12 in response to a character selection signal so that a selected character is stopped at the printing position, detains the type wheel unit 23 at the position until the selected character has been printed, and then releases the type wheel unit 23 after the selected character has been printed to allow the type wheel unit 23 to restore the initial position. In this embodiment, nine electromagnetic clutches 47 for character selecting operation are arranged axially on the second shaft 14. The number of the electromagnetic clutches 47 is half the number of the type wheel units 23. Each electromagnetic clutch 47 comprises a solenoid 50, a sleeve 49 formed of a magnetic material and rotatably fitted in the solenoid 50, and a holding member 51 holding the solenoid 50. The sleeve 49 is splined to the second shaft 14, so that the sleeve 49 rotates continuously together with the second shaft 14. A pair of selector plates 48 are mounted swingably on the second shaft 14 by the opposite ends of the electromagnetic clutch 47, respectively. The pair of selector plates 48 are pressed resiliently against the end surfaces of the sleeve 49 with spring plates 52 interposed between the pair of selector plates 48, and the selector plates 48, not shown, of the adjacent electromagnetic clutches 47, respectively. The pair of selector plates 48 are symmetrical in shape and disposition with respect to each other and are pressed resiliently against the opposite end surfaces of the sleeve 49, respectively. Each selector plate 48 has a circular central portion covering the end surface of the solenoid 50, a selector finger 53 extending from the central portion so as to engage with the notch of the selector ratchet 26 to stop the type wheel 24 so that a selected character is located at the printing position, a detaining finger 55 extending from the central portion so as to engage with the bend **54*a* of a detaining spring 54 fixed to the case 1, a tongue 57 extending from the central portion and serving as part of a magnetic path for the lines of magnetic force generated by the solenoid 50, and a releasing finger 58 projecting from the central portion for disengaging the selector finger 53 from the notch of the selector ratchet 26 to reset the type wheel unit 23**.

While the solenoid 50 is not energized, the pair of selector plates 48 are held at the resting position with the detaining fingers 55 thereof held under the bends 54*a* of the detaining springs 54 against the frictional force urging the selector plates 48 in a direction to engage the selector ratchets 26 applied thereto by the sleeve 49. When the solenoid 50 is energized, the pair of selector plates 48 are attracted to the sleeve 49 by a magnetic force generated by the solenoid 50. Consequently, the selector plates 48 are urged counterclockwise, as viewed in FIG. 1, by the rotative force of the second shaft 14 to make the detaining fingers 55 move over the bends 54*a* of the detaining springs 54, respectively. The sleeve 49, the central portion of the right-hand selector plate 48, the tongue 57 of the right-hand selector plate 48, the tongue of the left-hand selector plate 48 and the central portion of the left-hand selector plate 48 form a closed magnetic path. If the tongues 57 of the pair of selector plates 48 are firmly attracted to each other when the solenoid 50 is energized, it is impossible to drive one of the pair of selector plates 48 individually relative to the other. Accordingly, in this embodiment, small round projections 59 one on each tongue 57 are formed in the opposite surfaces of the tongues 57 to reduce the friction between the tongues 57 by reducing the contact area between the tongues 57 without reducing the magnetic flux density. Preferably, at least two circular projections 59 are formed on the tongues 57, because a single projection is liable to spoil the parallelism between the selector plates 48. The projections 59 may be formed either on either tongue 57 or on both the tongues 57. The projection 59 is formed in the least possible height to prevent the reduction of the magnetic flux density.

An elongate cam bar 60 for driving the eighteen selector plates 48 is secured to the cam shaft 9. The cam bar 60 has a plurality of reset cams 61 which engage with the releasing fingers 58 to turn the selector plates 48 clockwise, as viewed in FIG. 1, to release the selector fingers 53 from the selector ratchets 26, respectively, and check cams 62 formed between the adjacent reset cams 61 to check the selector plates 48 so that the selector plates 48 will not be turned excessively clockwise beyond the initial position during resetting motion. The reset cam 61 turns the selector plate 48 clockwise so that the selector finger 53 is disengaged from the notch 39 of the selector ratchet 26 and the detaining finger 55 is moved over the bend 54*a* of the detaining spring 54. Each type wheel 24 has a reset cam 63 having an inclined cam surface 63*a*, formed on a circle greater than the outer circumference of the selector ratchet 26 so as to project from the side surface thereof facing the selector ratchet 26. The cam surface 63*a* of the reset cam 63 engages with the nose of the selector finger 53 to reset the selector plate 48 forcibly. Retaining springs 64 each for restricting the excessive clockwise turning of the selector plate 48 and for retaining the selector plate 48 at the initial position in cooperation with the bend 54*a* of the detaining spring 54 are fixed to the case 1. In this embodiment, each check cam 62 returns the selector plate 48 surely to the initial position even if the resilience of the retaining spring 64 is small. The use of the retaining spring 64 having a small resilience reduces torque demand for rotating the type wheels 24 at a high speed. When the selector plate 48 is turned clockwise for resetting, the check cam 62 engages slidably with a concave edge 57*a* of the tongue 57 to restrict the turning of the selector plate 48 beyond the initial position. The reset cams 61 other than those formed at the opposite ends of the reset cam arrangement, and the check cams 62 each has a width, namely, an axial length, sufficient for driving the corresponding pair of selector plates 48.

The printing mechanism 4 and the sheet feed mechanism 5 will be described hereinafter.

Brackets 65 are fixed to the opposite ends of the third shaft 18, and a round hammer rod 66 is supported rotatably on the brackets 65 opposite to the eighteen type wheel units 23 within the case 1. The hammer rod 66 revolves on the third shaft 18 along a circular path so as to press a recording sheet, not shown, through an ink ribbon, not shown, against the type wheels 24 for printing. The recording sheet is fed by means of a rubber feed roller 68 fixed to the fourth shaft 21 and a pinch roller 69 pressed against the feed roller 68 through a sheet feed path defined by sheet guides 67. In this embodiment, a printing force reinforcing cam 70 is fixed to one end of the third shaft 18 outside the bracket 65 and a torsion coil spring 71 having a coil portion 71*a* is wound around the fourth shaft 21 with the acting end 71*b* thereof in contact with the printing force reinforcing cam 70 to reinforce the printing force of the hammer rod 66. The acting end 71*b* of the torsion coil spring 71 always applies a resilient force acting in a direction indicated by an arrow in FIG. 1 to the printing force reinforcing cam 71.

The functions of the printer incorporating the character selecting mechanism 3 embodying the present invention will be described hereinafter.

Referring to FIG. 7(*a*), in which all the components are in the initial position, each selector plate 48 is urged resiliently counterclockwise by the retaining spring 64 engaging with the selector finger 53, however, since the detaining finger 55 is detained by the bend 54*a* of the detaining spring 54, the selector plate 48 is retained at the initial position.

When a print start command is given, the driving motor is started to rotate the driving gear 6; consequently, the cam shaft 9 and all the shafts 12, 14 and 18 of the type wheel mechanism 2, the character selecting mechanism 3 and the printing mechanism 4 except the fourth shaft 21 of the sheet feed mechanism 5 start rotating in directions indicated by arrows in FIG. 7(*a*), respectively. Since the pair of selector plates 48 disposed on the opposite sides of each electromagnetic clutch 47 are resiliently pressed against the opposite end surfaces of the sleeve 49, respectively, the selector plates 48 are urged counterclockwise by friction. However, since the selector plates 48 are restrained from counterclockwise turning by the engagement of the bends 54*a* of detaining springs 54 with the detaining fingers 55 thereto, the selector plates 48 are detained at the initial position.

Referring to FIG. 7(*b*) showing the mode of character selecting operation, the reset cams 61 of the cam bar 60 leave the releasing fingers 58 of the pair of selector plates 48, and then a character selection signal is provided to energize the solenoid 50 of the electromagnetic clutch 47 upon the arrival of a notch 39 of the selector ratchet 26 corresponding to a type 27 which is to be printed first among those of the pair of type wheels 24 at a position opposite the selector finger 53 of the relevant selector plate 48. That is, a pulse of character selection command current of a pulse width corresponding to a time substantially the same as a time in which the selector ratchet 26 turns through the center angle of a single notch thereof is supplied to the solenoid 50. Consequently, the solenoid 50 is energized to generate a closed magnetic field, whereby the pair of selector plates 48 are attracted firmly to the rotating sleeve 49. Since the small projections 59 are formed on the opposite surfaces of the tongues 57 of the pair of selector plates 48 and hence the friction between the tongues 57 is small, only the selector plate 48 having the selector finger 53 aligned with the notch 39 of the selector ratchet 26 is turned counterclockwise by the second shaft 14, so that the detaining finger 55 of the selector plate 48 is moved over the bend 54*a* of the detaining spring 54 and the selector finger 53 engages with the notch 39 to stop the corresponding selector ratchet 26. Since the phase of the selector ratchet 26 corresponding to the other selector plate 48 is shifted by half a pitch relative to the phase of the former selector ratchet 26, the selector finger 53 of the other selector plate 48 is unable to drop into the notch 39 of the corresponding selector ratchet 26 and hence the other selector plate 48 is unable to be turned counterclockwise. Since the resilience of the detaining spring 54 is comparatively small, only a small driving force is necessary to move the detaining finger 55 over the bend 54*a* of the detaining spring 54. Therefore, the driving motor and the solenoid 50 may be comparatively small in capacity, and hence the power consumption of the printer is comparatively small.

Each type wheel unit 23 is operatively connected to the first shaft 12 by the engagement of the projection 35 of the clutch plate 25 with the axial groove 34 of the first shaft 12. That is, the clutch plate 25 and the type wheel 24 are joined together by pivotally supporting the clutch plate 25 on the pin 33 fixed to the type wheel 24 and inserted in the small hole 32 formed in the clutch plate 25, and the driving force of the first shaft 12 is transmitted to the selector ratchet 26 through the clutch plate 25 engaging at the nose 36 of the rigid portion 30 thereof with the pin 37 fixed to the selector ratchet 26. Since the axial groove 34 is a substantially V-shaped groove having a radial surface for engagement with the projection 35 of the clutch plate 25, the projection 35 of the clutch plate 25 engages firmly with the axial groove 34 of the first shaft 12, so that the type wheel unit 23 is rotated positively by the first shaft 12.

The selector finger 53 engages with the notch 39 of the selector ratchet 26 to hold the selector ratchet 26 stationary. However, since the projection 35 of the clutch plate 25 and the groove 34 of the first shaft 12 are engaged, the type wheel 24 and the clutch plate 25 rotate further together with the first shaft 12 relative to the selector ratchet 26. During the rotation of the type wheel 24 relative to the selector ratchet 26, the pins 33 and 38 move in the slots 41 and 42, respectively. Since the two projections 44 each having the hook 43 and the other two projections 44 projecting from the side surface of the selector ratchet 26 are fitted loosely in the two openings 45 and two recesses 46 of the type wheel 24, respectively, the type wheel 24 and the selector ratchet 26 are rotatable relative to each other.

Referring to FIG. 7(*c*), when the type wheel 24 and the clutch plate 25 are turned further from a state in which the nose 36 of the rigid portion 30 of the clutch plate 25 is in contact with the pin 37 of the selector ratchet 26 which is now stationary, the nose 36 is moved over the pin 37, whereby the projection 35 of the clutch plate 25 is moved gradually away from the groove 34 of the first shaft 12 as indicated by broken lines. Then, as illustrated in FIGS. 4 and 7(*c*), upon the arrival of the selected type 27 of the type wheel 24 at the printing position and immediately before the projection 35 of the clutch plate 25 is disengaged completely from the groove 34 of the first shaft 12, the rear surfaces, with respect to the direction of rotation, of the openings 45 and recesses 46 of the type wheel 24 come into abutment with the rear surfaces, with respect to the direction of rotation, of the four projections 44 of the stationary selector ratchet 26 to stop the selected type 27 of the type wheel 24 exactly at the printing position. Consequently, the clutch plate 25 is stopped, then the projection 35 of the clutch plate 25 is raised gradually by the inclined surface 34*a* of the groove 34 as the first shaft 12 rotates further and, finally, the projection 35 is removed from the groove 34, so that the type wheel unit 23 is stopped and the first shaft 12 continues rotating.

Since the stopping mechanism of the present invention positions the selected type 27 of the type wheel 24 at the printing position through the engagement of the four projections 44, and the two openings 45 and the two recesses 46, the stopping mechanism is able to position the selected type 27 of the type wheel 24 surely and very accurately as compared with the conventional type positioning means which determines the printing position of the type at the moment of complete separation of the tip of the projection 35 of the clutch plate 25 from the groove 34. Even if the tip of the projection 35 of the clutch plate 25 is worn, the selected type 27 of the type wheel 24 can be accurately held at the printing position. Thus, the character selecting operation for one of the pair of the type wheel units 23 is completed.

Character selecting operation for the other type wheel unit 23 is similar to that for the former type wheel unit 23. Upon the arrival of a notch 39 of the selector ratchet 26 corresponding to a selected type at a position opposite the selector finger 53 of the relevant selector plate 48, a character selection command current is supplied to the solenoid 50 of the electromagnetic clutch 47. The sequence of the rest of the steps of the character selection operation is the same as that described with reference to the former type wheel unit 23.

After the selected types 27 of the eighteen type wheels 24 have been positioned at the printing position, the printing mechanism 4 executes printing operation. The ink ribbon and the recording sheet are disposed opposite the respective front surfaces of the eighteen type wheels 24. As the third shaft 18 is rotated, the hammer rod 66 revolves around the axis of the third shaft 18 (FIG. 1) and presses the ink ribbon and the recording sheet firmly against the stationary type wheels 24 to print the selected characters of the types 27 on the recording sheet. As the hammer rod 66 approaches the type wheels 24, the torsion coil spring 71 disposed behind the hammer rod 66 applies a resilient force to the printing force reinforcing cam 70 to assist the counterclockwise revolution of the hammer rod 66 so that the pressure of the hammer rod 66 on the type wheels 24 is enhanced, whereby the printing mechanism 4 of the ink ribbon type exerts a sufficient printing force on the type wheel to ensure high-quality print. The printing force reinforcing cam 70 is designed so that the torsion coil spring 71 is strained gradually until the hammer rod 66 arrives at the printing position and the torsion coil spring 71 exerts a greatest resilient force on the printing force reinforcing cam 70 upon the arrival of the hammer rod 66 at the printing position. Although the revolving hammer rod 66 applies a force urging the type wheels 24 clockwise, all the type wheels 24 are held stably at the correct printing position, because the selector fingers 53 are in engagement with the corresponding notches 39 of the selector ratchets 26 to hold the selector ratchets 26 stationary and each type wheel 24 is held unmovable by the engagement of the four projections 44 of the corresponding selector ratchet 26, and the two openings 45 and two recesses 46 thereof. Accordingly, high-quality clear print is obtained.

After the selected characters have been printed, the sheet feed mechanism 5 feeds the recording sheet and, at the same time, the type wheel mechanism 2 and the character selecting mechanism 3 implement type wheel resetting operation.

Upon the completion of the printing operation, the partial gear 20 and the transmission gear 22 engage to rotate the feed roller 68 by a predetermined angle to feed the recording sheet held between the feed roller 68 and the pinch roller 69 along the sheet guides 67 by a predetermined length.

On the other hand, the type wheels 24 are reset in the following manner.

Referring to FIG. 7(*d*), as the cam shafts 9 and other shafts 12, 14, 18 and 21 rotate further after the hammer rod 66 has completed the printing operation, each reset cam 61 of the cam bar 60 engages with the releasing finger 58 of the corresponding selector plate 48 to turn the selector plate 48 clockwise against the resilient resistances of the detaining spring 54 and the retaining spring 64, so that the selector finger 53 of the selector plate 48 is disengaged from the notch 39 of the corresponding selector ratchet 26 as illustrated in FIG. 7(*e*), in which the reset cam 61 of the cam bar 60 is in engagement with the releasing finger 58 of the selector plate 48 to restrain the selector plate 48 from counterclockwise turning. Consequently, the selector ratchet 26, the clutch plate 25 and the type wheel 24 are released free, and then the projection 35 of the clutch plate 25 engages frictionally with the first shaft 12 to transmit the rotative force of the first shaft 12 to the selector ratchet 26, so that the selector ratchet 26 and the type wheel 24 are rotated by the first shaft 12. Then, the inclined cam surface 63*a* of the reset cam 63 engages with the tip of the selector finger 53 of the selector plate 48 as shown in FIG. 7(*f*). By this moment, the check cam 62 of the cam bar 60 has already arrived at a position where the check cam 62 engages with the concave edge 57*a* of the tongue 57 of the selector plate 48. Therefore, the reset cam 63 of the type wheel 24 is unable to turn the selector plate 48 clockwise and hence the first shaft 12 and the clutch plate 25 slip relative to each other, so that the type wheel 24 is stopped. As the first shaft 12 rotates further, the groove 34 arrives at a position opposite the projection 35 of the clutch plate 25. Then, the projection 35 is dropped into the groove 34 by the resilience of the flexible portion 31 of the clutch plate 25 to engage the clutch plate 25 and the first shaft 12 as shown in FIG. 7(*g*). The check cam 62 of the cam bar 60 is disengaged from the tongue 57 of the selector plate 48 immediately before the engagement of the first shaft 12 and the clutch plate 25. After the groove 34 of the first shaft 12 and the projection 35 of the clutch plate 25 have been engaged, the type wheel 24 rotates together with the first shaft 12 and the reset cam 63 of the type wheel 24 causes the selector plate 48 to turn clockwise against the resilience of the retaining spring 64 as shown in FIG. 7(*h*). Thus, the type wheel 24 is reset at the initial position.

During the type wheel resetting operation, the reset cam 61 of the cam bar 60 is in engagement with the releasing finger 58 of the selector plate 48 to restrain the selector plate 48 from counterclockwise turning after the selector finger 53 has been disengaged from the notch 39 of the selector ratchet 26 to ensure the type wheel resetting operation. Further, the reset cam 63 of the type wheel 24 and the selector finger 53 of the selector plate 48 are engaged and the check cam 62 of the cam bar 60 and the curved edge 57*a* of the tongue of the selector plate 48 are engaged to make the projection 35 of the clutch plate 25 engage with the groove 34 of the first shaft again, so that the type wheel 24 is reset securely. Accordingly, the resilience of the retaining spring 64 for suppressing the clockwise turning of the selector plate 48 during the type wheel resetting operation may be small, the selector plate 48 can be turned clockwise by a small force applied thereto by the reset cam 63, and hence the capacity of the driving motor for rotating the first shaft 12 may be small.

Upon the completion of the type wheel unit resetting operation, a print end signal is provided and, at the same time, current supply to the driving motor is interrupted to stop the shafts, whereby the components of all the mechanism stop at the initial position. The progress of the printing cycle is monitored through the detection of slits 73 formed in a sensor plate 72 fixedly attached to the left end of the cam shaft 9 by a sensor, not shown.

Thus, a line of characters are printed in one printing cycle. The printing cycle is repeated for printing a plurality of lines of characters.

As apparent from the foregoing description, according to the present invention, the pair of selector plates 48 each having the selector finger 53 of the pair of type wheel units 23 are driven individually by a single electromagnetic clutch 47, and the tongues 57 of the pair of selector plates 48 are in contact with each other to form a magnetic path for the magnetic lines of force of the solenoid 50 of the electromagnetic clutch 47. Accordingly, the character selecting mechanism according to the present invention is very simple in construction.

Furthermore, since the small projections are formed in the contact surfaces of the tongues 57 of the selector plates 48 to dispose the selector plates 48 with a small gap between the contact surfaces of the tongues 57 and to reduce the contact area between the tongues 57, the selector plates 48 can be individually driven. Accordingly, the character selecting mechanism is suitable for a printer which operates at a comparatively low printing speed, needs a small number of parts and can be easily assembled at a low cost.

Still further, The small round projections for reducing the contact area between the tongues of the selector plates may be substituted, for example, by small ridges for the same effect.

Although the invention has been described in its preferred form with a certain degree of particularity, it is to be understood to those skilled in the art that many changes and variations are possible in the invention without departing from the scope and spirit thereof.

What is claimed is:

1. In a printing mechanism of the type including a plurality of axially aligned type-wheels, rotatable around a shaft, with typeface thereon for printing characters onto a medium, wherein a selector plate associated with each type-wheel, as part of a character selecting mechanism, engages said associated type-wheel for temporarily fixing said type-wheel in a particular position for printing a particular character, an improved selecting mechanism comprising:

a plurality of electromagnetic clutches, each having a solenoid, each solenoid having a center hole;

a sleeve rotatably received in the center hole of each solenoid and rotated continuously;

a pair of selector plates resiliently pressed against opposite end surfaces of the sleeve, respectively, so as to be attracted to the sleeve and to be turned by the sleeve, engaging said type-wheel, when an associated solenoid is energized in response to a character selection signal, each of said selector plates having a tongue, wherein the tongues of said pair of selector plates face opposite each other to form part of a magnetic path for magnetic lines of force produced by the solenoid, said tongues facing opposite each other having a small gap therebetween, except for where said facing tongues are in contact with each other through a contact area.

2. A character selecting mechanism as recited in claim 1, wherein said tongues are in contact with each other through one or more projections offering low frictional contact, formed in one of the opposite surfaces of the tongues.

3. A character selecting mechanism as recited in claim 1, wherein said tongues are in contact with each other through projections offering low frictional contact, formed in both the opposite surfaces of the tongues.

* * * * *